United States Patent [19]

Thomas

[11] Patent Number: 4,979,610

[45] Date of Patent: Dec. 25, 1990

[54] CASE FOR CULINARY INSTRUMENTS AND THE LIKE

[75] Inventor: Erik P. Thomas, Little Compton, R.I.

[73] Assignee: Johnson & Wales University, Providence, R.I.

[21] Appl. No.: 445,808

[22] Filed: Nov. 20, 1989

[51] Int. Cl.[5] ..... B65D 85/20

[52] U.S. Cl. ..... 206/45.110; 206/553; 220/94 A

[58] Field of Search ..... 206/44 R, 44.12, 45, 206/45.11, 45.2, 45.23, 45.24, 223, 371, 542, 553, 564, 576; 220/94 A

[56] References Cited

U.S. PATENT DOCUMENTS

| | | | |
|---|---|---|---|
| Re. 10,132 | 6/1882 | Laraway et al. | 206/553 |
| 708,489 | 9/1902 | Morris | 206/45.11 |
| 1,666,668 | 4/1928 | Purchas | 206/45.2 |
| 1,939,497 | 12/1933 | Herring | 206/564 |
| 2,366,046 | 12/1944 | Naken | 206/553 |
| 2,619,251 | 11/1952 | Schmidt | 220/94 A |
| 2,710,094 | 6/1955 | Rau | 206/553 |
| 2,807,361 | 9/1957 | Junkin | 206/553 |
| 4,573,569 | 3/1986 | Parker | 206/45.2 |
| 4,613,041 | 9/1986 | Carlton | 206/373 |
| 4,938,688 | 2/1976 | Ryan | 220/94 A |

FOREIGN PATENT DOCUMENTS

| | | | |
|---|---|---|---|
| 0712973 | 8/1931 | France | 206/45.2 |
| 0004816 | of 1878 | United Kingdom | 206/373 |
| 0452883 | 9/1936 | United Kingdom | 206/45.23 |

*Primary Examiner*—Jimmy G. Foster
*Attorney, Agent, or Firm*—Salter & Michaelson

[57] ABSTRACT

A case for instruments, such as knives and other culinary instruments, comprises a base portion including first and second hingeably connected base portion sections, a cover portion including first and second cover portion sections which are hingeably connected to the first and second base portion sections, respectively, and a positioning member which is operative for receiving and releasably securing instruments in the base portion. The case is alternatively positionable in a closed position wherein the cover portion sections are received on the base portion sections, an open position wherein the cover portion sections are hinged outwardly from the base portion sections, or a workstation position wherein the second base portion section and the second cover portion section are hinged outwardly to positions wherein they are operative for supporting the first base portion section in an angular disposition on a supporting surface so that instruments can readily removed from the first base portion section as needed.

10 Claims, 5 Drawing Sheets

CASE FOR CULINARY INSTRUMENTS AND THE LIKE

BACKGROUND AND SUMMARY OF THE INVENTION

The instant invention relates to carrying cases and more particularly to an effective carrying case for transporting and storing instruments, such as culinary instruments, including knives and the like, so that they are readily accessible when needed.

It has been found that it is often necessary for persons, such as those engaged in the culinary arts to transport the tools of their trade from location to location. For example, it has been found that it is often necessary for chefs to transport their knives, etc., to various locations where they are engaged in catering operations or culinary expositions. It has also been found that it is often necessary for culinary students to transport their culinary instruments between home and the classroom. However, while various cases which have been adapted for receiving and containing instruments, such as culinary instruments including knives and the like, have been heretofore available, the previously available cases have generally not been adapted for effectively transporting and storing instruments so that they are readily available and easily removable when needed.

The instant invention provides an effective case which is adapted for storing and transporting instruments, such as culinary instruments and the like, so that they are easily removable and readily available for use when needed. Specifically, the case of the instant invention comprises a base portion including a bottom wall and an upstanding peripheral side wall, means for receiving and releasably positioning a plurality of culinary instruments in the base portion, and a cover portion which is hingeably attached to the base portion so that it is hingeable between open and closed positions. The positioning means in the base portion preferably includes a plurality of slots which are adapted for receiving an frictionally retaining prespecified instruments therein and the case preferably further includes a removable retaining plate for further removably retaining instruments in the slots. The base portion preferably comprises hingeably connected first and second base portion sections and the positioning means is preferably integrally molded in the first base portion section. The second base portion section is preferably hingeable relative to the first base portion section to a workstation position wherein the second base portion is operative in a manner similar to an easel support for maintaining the first base portion section in an angular disposition on a supporting surface. The cover portion preferably comprises first and second cover portion sections which are hingeably connected to the first and second base portion sections, respectively, and adapted for covering the first and second base portion sections, respectively. Further, the second cover portion section is preferably hingeable to a position wherein it engages the first base portion section when the first base portion section is in the workstation position thereof in order to prevent further pivoting of the second base portion section toward the first base portion section. Still further, the second cover portion section is preferably attached to the second base portion section so that it is prevented from pivoting beyond a predetermined angular relation therewith wherein the second cover portion section is operative for engaging a supporting surface to prevent pivoting of the second base portion section away from the first base portion section when the case in in the workstation position. The case preferably further includes means for releasably positioning a plurality of culinary instruments in the first cover portion section and handle means which is preferably integrally molded in the base portion for carrying the case as it is transported.

It has been found that the case for instruments of the instant invention can be effectively utilized for transporting and storing culinary instruments, such as knives and the like. In this regard, the cover portion of the case is easily hingeable to an open position to provide access to instruments stored in the case. Further, the second base portion section is easily hingeable to the support position wherein the first base portion section is supportable in an angular disposition on a supporting surface. When the first base portion section is supported on a supporting surface in this manner, the case provides an effective workstation unit which is adapted for supporting knives and the like so that they can be readily removed as needed. Further, because the base portion positioning means is integrally molded with the first base portion section and because the retaining plate is removable from the base portion positioning means, the case can be more effectively cleaned and washed, such as by placing it in an automatic dishwasher.

Accordingly, it is a primary object of the instant invention to provide an effective case for transporting and storing instruments, such as knives and the like.

Another object of the instant invention is to provide an effective case for culinary instruments and the like which is adapted to be positioned in a workstation position wherein culinary instruments received therein are maintained in angular dispositions so that they can be readily removed from the case.

Another object of the instant invention is to provide an effective case for culinary instruments which is adapted to be readily cleaned and washed, such as by placing it in an automatic dishwasher.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
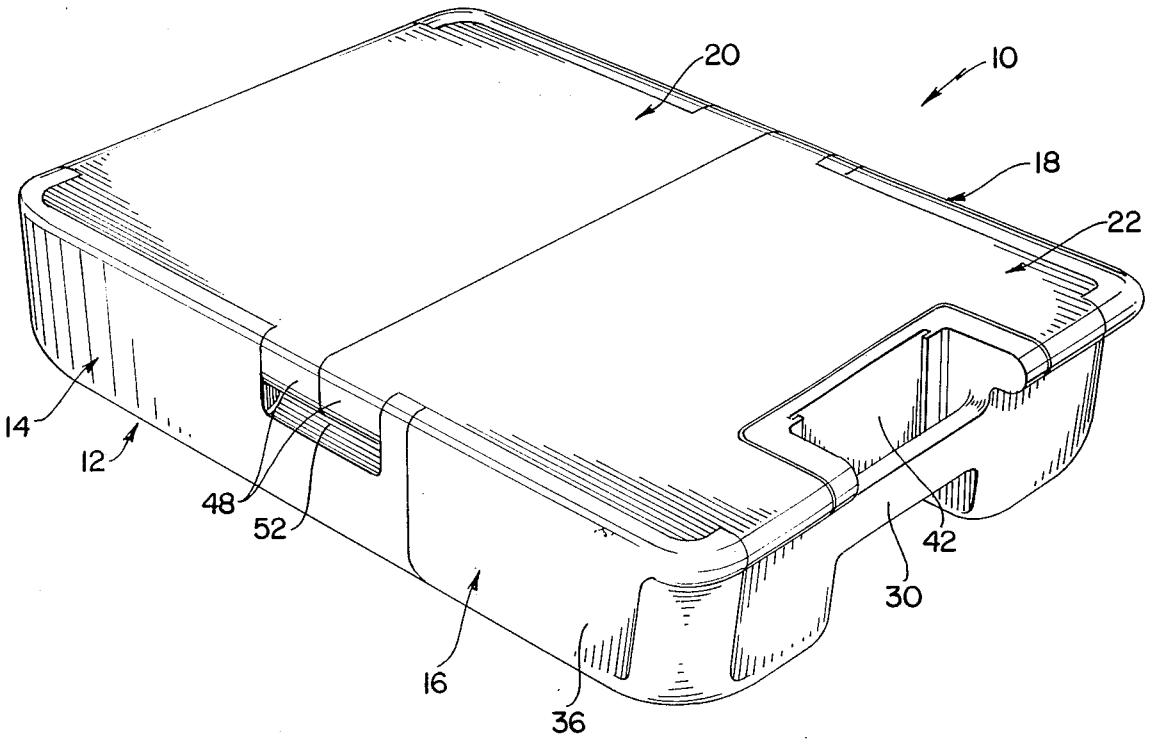
FIG. 1 is a perspective view of the case for culinary instruments of the instant invention in a closed position.
Figure 2:
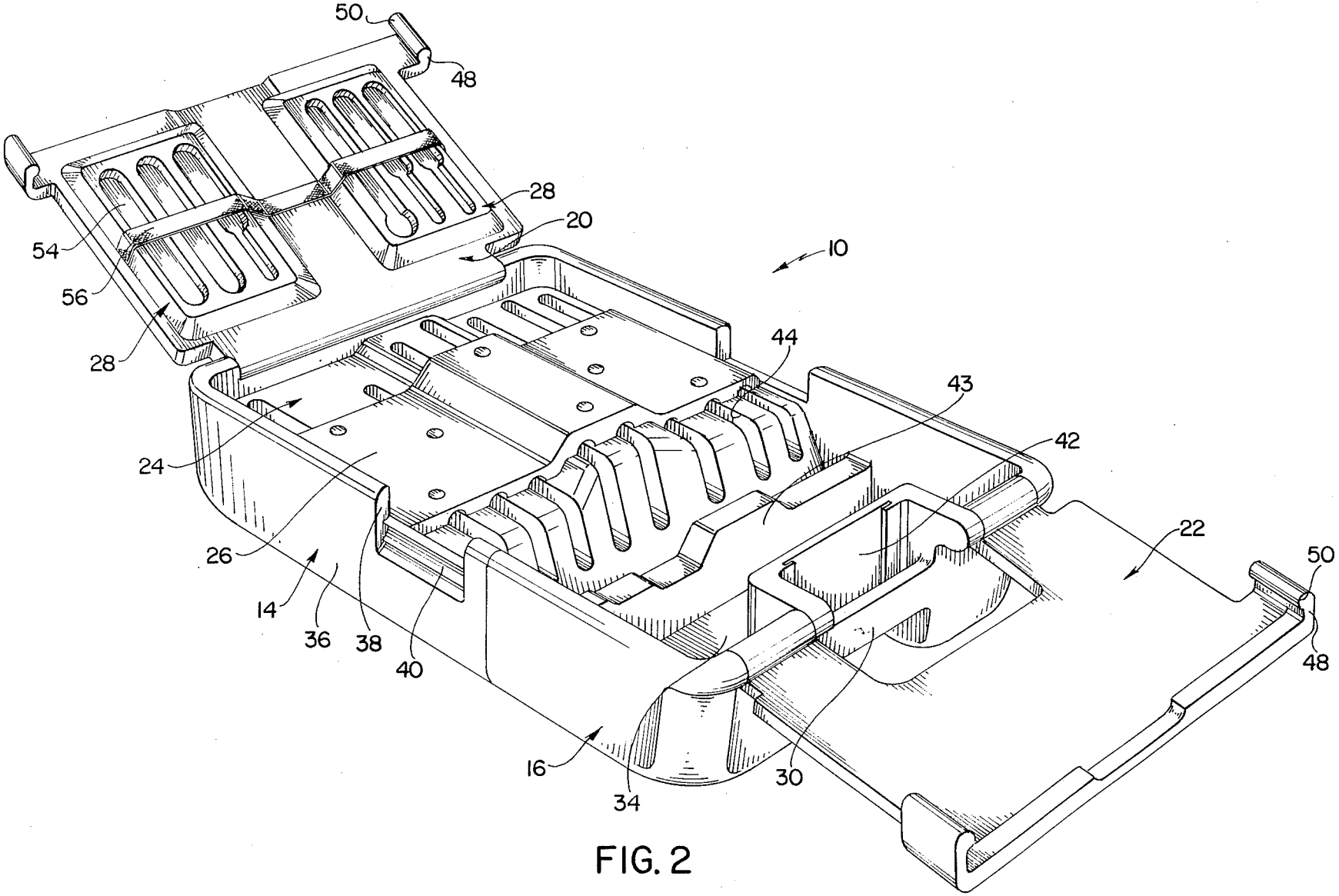
FIG. 2 is a perspective view thereof in an open position.
Figure 3:
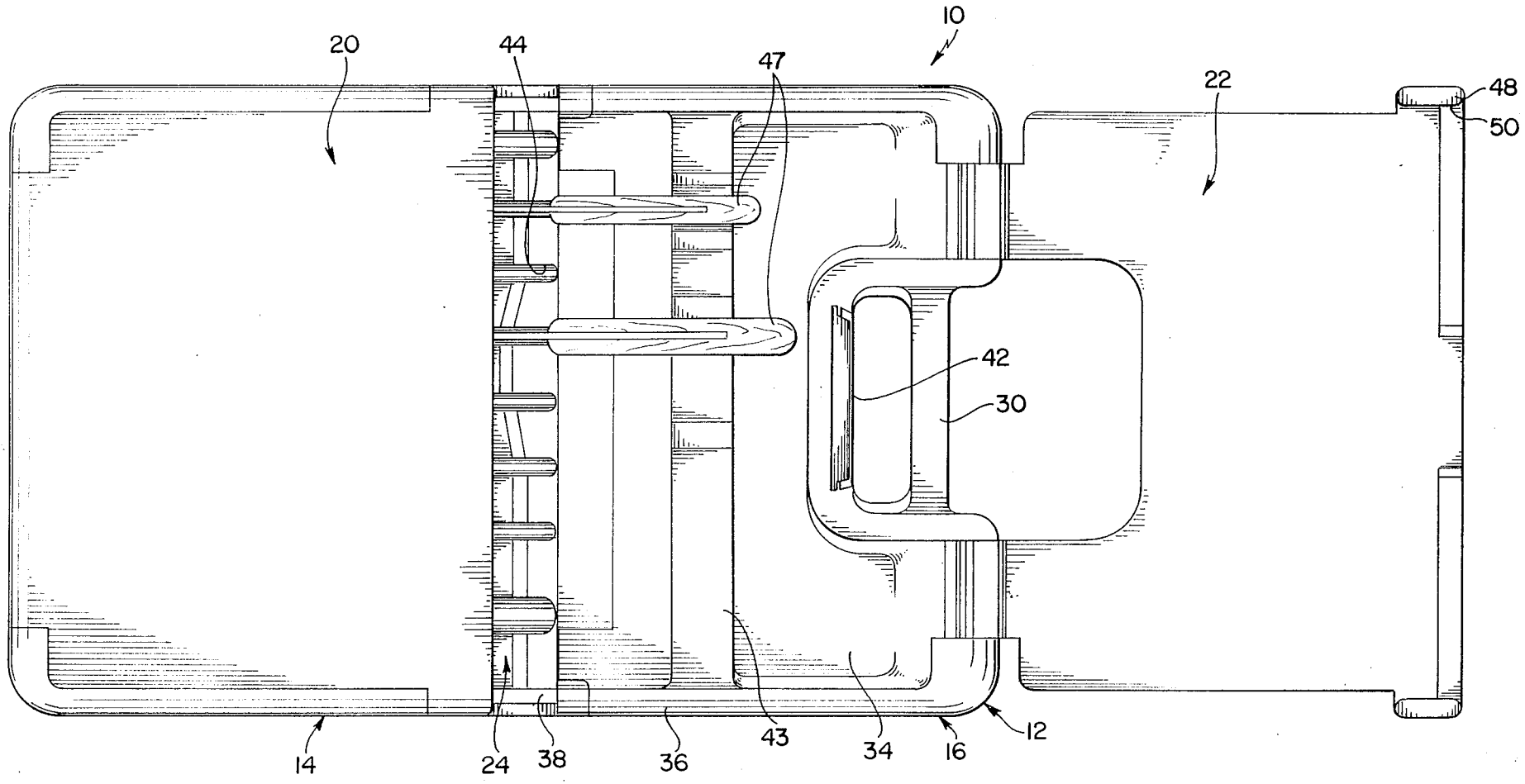
FIG. 3 is a top plan view thereof in a partially open position.

Referring now to the drawings, the case for instruments of the instant invention is illustrated and generally indicated at 10 in FIGS. 1 through 5. The case 10 as herein embodied is specifically adapted for carrying culinary instruments, although it will be understood that other embodiments which are adapted for carrying other types of instruments are contemplated. The case 10 comprises a base portion generally indicated at 12, including first and second base portion sections generally indicated at 14 and 16, respectively, a cover portion generally indicated at 18, including first and second cover portion sections generally indicated at 20 and 22, respectively, a base portion positioning member generally indicated at 24, a retaining plate 26, a pair of cover portion positioning members generally indicated at 28, and a handle portion 30. The first and second base portion sections 14 and 16, respectively, are hingeably interfitted along a hinge axis 32 (see FIG. 5) and the first and second cover portion sections 20 and 22, respectively, are hingeably interfitted with the first and second base portion sections 14 and 16, respectively at opposite ends of the case 10. The base portion positioning member 24 is received in the interior of the first base portion section 14 and it is operative for receiving and positioning a plurality of culinary instruments, such as knives or the like, in the case 10. The cover portion positioning members 28 are received and secured on the inner side of the first cover portion section 20 and they are also adapted for receiving and positioning a plurality of culinary instruments in the interior of the case 10. The first and second base portion sections 14 and 16, respectively, and the first and second cover portion sections 20 and 22, respectively, are adapted to be hinged between the closed position illustrated in FIG. 1 and the open position illustrated in FIG. 2. The first and second base portion sections 14 and 16, respectively, and the first and second cover portion sections 20 and 22, respectively, are also adapted to be hinged to the workstation position illustrated in FIG. 5 wherein the second base portion section 16 and the second cover portion section 22 cooperate to retain the first base portion section 14 in an angular disposition on a supporting surface so that culinary instruments and the like can be readily removed from the base portion positioning member 24 as needed.

The base portion 12 is preferably of substantially rectangular configuration and it includes a substantially rectangular two piece bottom wall 34 and a upstanding peripheral sidewall 36 which extends around substantially the entire periphery of the bottom wall 34 and therefore defines the outwardly facing extremities of the bottom portion sections 14 and 16. The bottom portion sections 14 and 16 are preferably each integrally molded from a suitable plastic material, such as polypropylene, which is capable of withstanding elevated temperatures and hence capable of being washed in an automatic dishwasher. A pair of notches 38 are formed on opposite sides of the first base portion section 14 and detent channels 40 are formed in the notches 38. An open area 42 is formed in the second base portion section 16 and the handle element 30 is integrally formed with the second base portion section 16 so that it extends across the mouth of the open area 42. Also included in the base portion 12 is a transversely extending handle rest 43 which is integrally molded in the second base portion section 16 and operative for supporting the handle portions of knives or the like received in the base portion 12.

Figure 4:
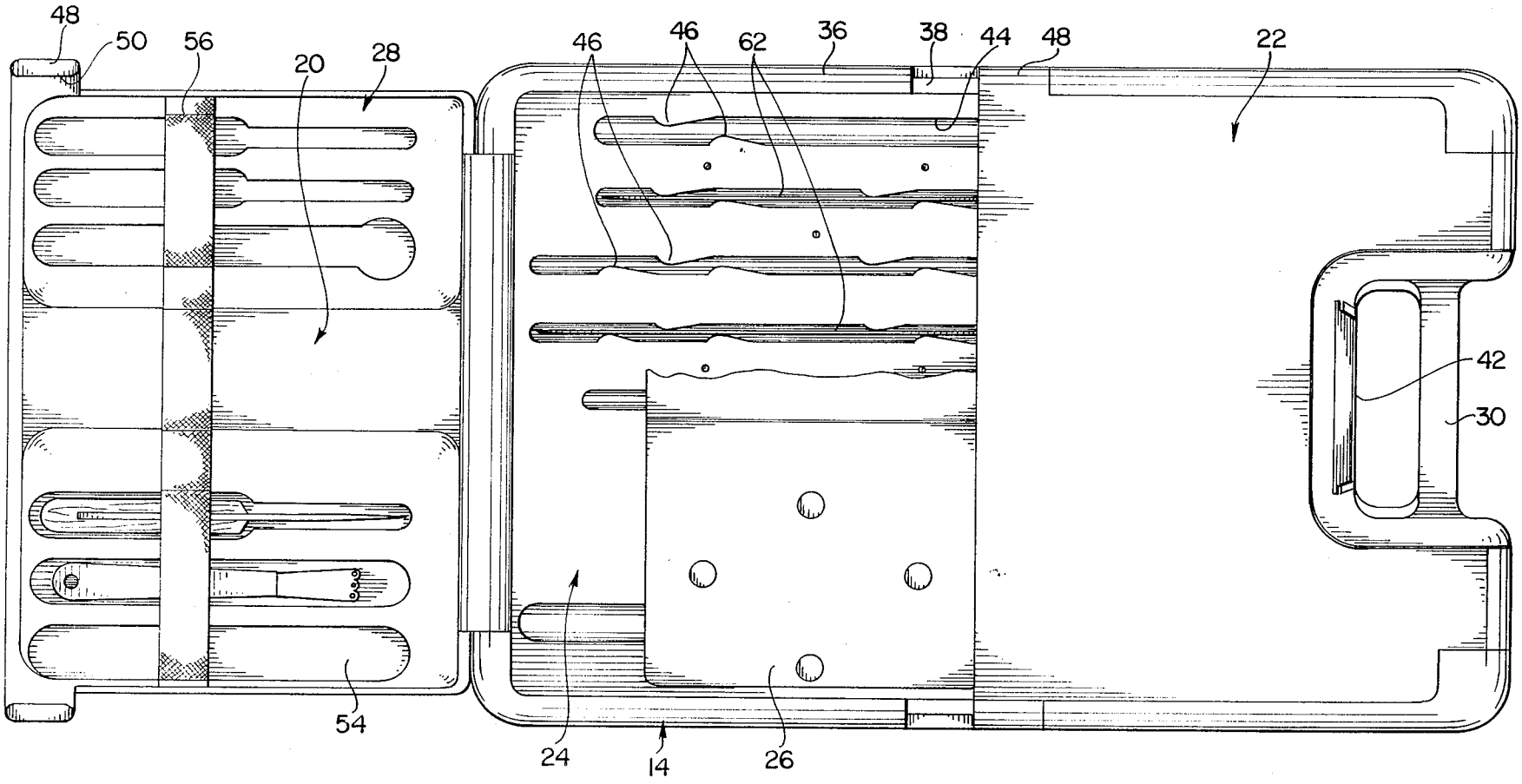
FIG. 4 is a fragmentary top plan view thereof in another partially open position.

The base portion positioning member 24 is preferably integrally molded with the first base portion section 14 from a suitable durable plastic material, such as polypropylene, and it is formed so that it includes a plurality of elongated upwardly opening slots 44. Further, as illustrated in FIG. 4, the slots have bumps 46 formed therein which are frictionally engageable with the blade portions of knives 47 to retain the knives 47 in predetermined positions in the slots 44. The slots 44 are positioned so that when the knives 47 are received threin, the handle portions of the knives 47 rest on the handle rest 43 in the second base portion section 16.

The retaining plate 26 is snap-received in engagement with the side wall 36 so that it is retained on the upper surface of the positioning member 24 as illustrated. Accordingly, the retaining member 26 is operative for retaining the blade portions of knives 47 in the slots 44 so that the knives 47 can only be removed by drawing them outwardly through the ends of the slots 44.

The first and second cover portion sections 20 and 22, respectively, are preferably also each integrally molded from a suitable plastic material, such as polyethylene. As illustrated, the first cover portion section 20 is hingeably attached to the first base portion section 14 at one end of the case 10, whereas the second cover portion section 22 is preferably hingeably attached to the second base portion section 16 at the other end of the case 10. The first and second cover portion sections 20 and 22, respectively, are dimensioned and configured so that they are operative for substantially covering the first and second base portion sections 14 and 16, respectively. Further, the first and second cover portion sections 20 and 22, respectively, each include a pair of downwardly extending retaining arms 48 having inwardly projecting ridges 50 thereon which are receivable in engagement in the detent channels 40 for releasably retaining the cover portion sections 20 and 22 in the closed positions thereof on the base portion 12. Still further, as illustrated in FIG. 1, the retaining arms 48 and the slots 38 are dimensioned so that they cooperte to define open areas 52 beneath the retaining arms 48 when the cover portion sections 20 and 22 are in the closed positions thereof so that the ridges 50 can be more easily disengaged from the channels 40 to move the cover portion sections 20 and 22 to the open positions thereof.

The cover portion positioning members 28 are preferably integrally molded with the first cover portion section 20 and they ar formed so that they each define a plurality of recesses 54 which are dimensioned and configured for receiving various specific types of culinary instruments therein. A retaining strap 56 is secured to the underside of the first cover portion section 20 so that it extends across the recesses 54 in order to retain culinary instruments therein.

Figure 5:
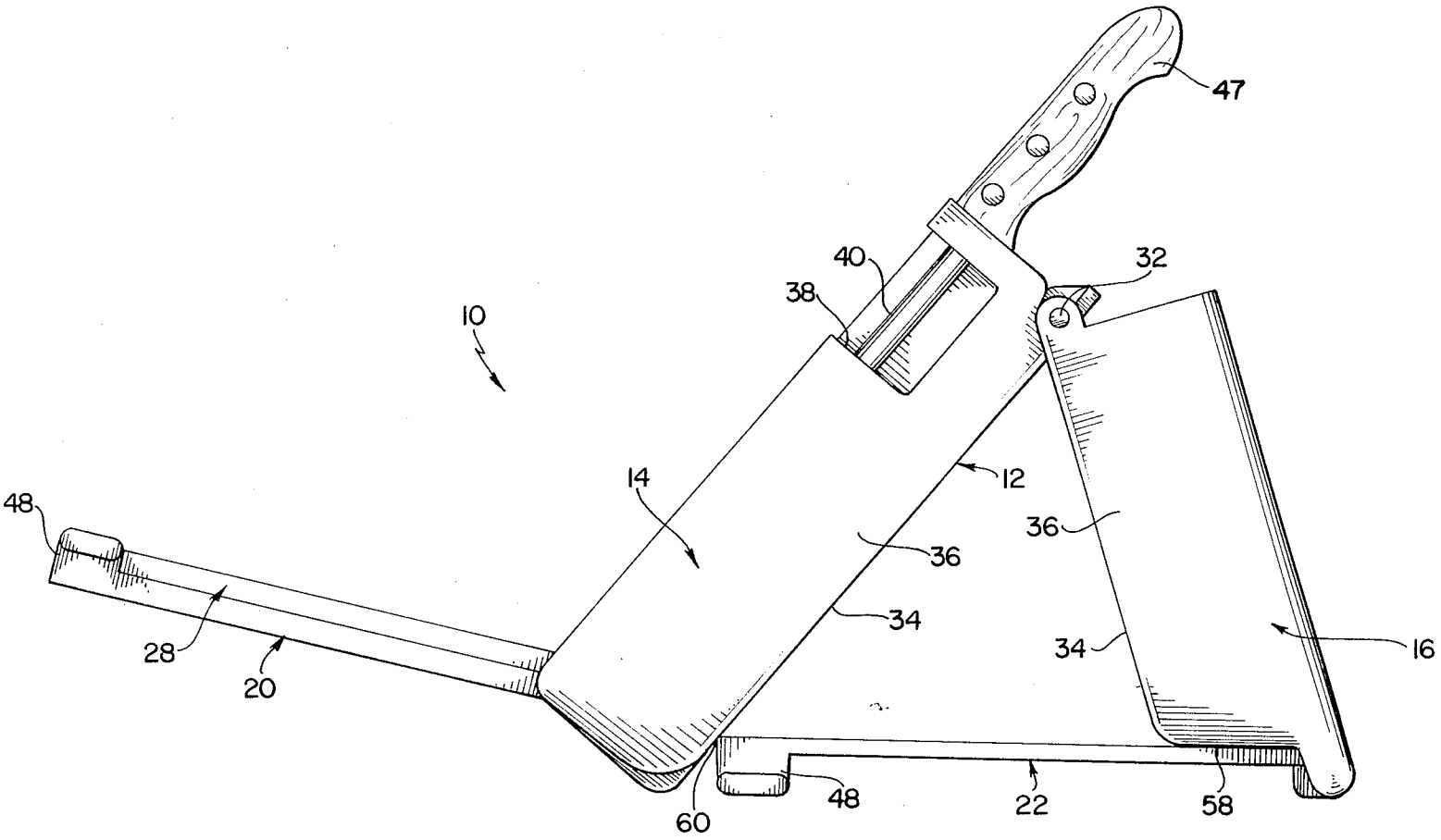
FIG. 5 is a side elevational view thereof in a workstation position.

Referring to FIG. 5, the workstation position of the case 10 is illustrated. As will be seen, when the case 10 is in the workstation position, the second cover portion section 22 is hinged to a fully open position wherein it engages the end wall of the second base portion section 16 as at 58 to prevent the second cover portion section 22 from pivoting further. In addition, the second base portion section 16 is pivoted downwardly relative to the first base portion section 14 to a position wherein the second cover portion section 22 engages the first base portion section 14 as at 60. When the stand 10 is in this position, the second cover portion section 22 engages the first base portion section 14 to prevent the second base portion section 16 from being pivoted toward the first base portion section 14. Further, when the stand 10 is received on a supporting surface, the second cover portion section 22 engages the supporting surface and the second base portion section 16 to prevent the second base portion section 16 from being pivoted away from the first base portion section 14. Accordingly, the second base portion section 16 and the second cover portion section 22 cooperate to effectively retain the first base portion section 14 in an angular disposition wherein the second base portion section 16 functions in a manner similar to an easel support for supporting the first base portion section 14 in an angular disposition. Further, as will be readily apparent, when the case 10 is in the workstation position illustrated in FIG. 5, various culinary instruments, such as the knives 47 can be effectively and easily removed from the stand 10 when needed. Similarly, culinary instruments received in the recesses 54 in the positioning members 28 can also be readily and easily accessed when needed.

It is seen therefore that the instant invention provides an effective case for transporting and storing culinary instruments. The case 10 is adapted for receiving a plurality of instruments, such as the knives 47 and the like in the slots 44 in the positioning member 24, and it is adapted for receiving a plurality of other culinary instruments in the recesses 54. Further, the case 10 can be readily and easily moved between the closed position thereof illustrated in FIG. 1 and the open position thereof illustrated in FIG. 2. In addition, the case 10 can be effectively and easily positioned in the workstation position illustrated in FIG. 5 wherein knives and the like contained in the case 10 are readily and easily accessible when needed. Further, because the main components of the case 10 are integrally molded from a suitable plastic material, the case 10 is effectively adapted to be easily cleaned when necessary. Consequently, it is seen that the case 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A case for culinary instruments comprising:

(a) a base portion having opposite ends;

(b) base portion positioning means defining a plurality of slots for receiving and releasably positioning a plurality of prespecified types of culinary instruments in said base portion;

(c) retaining means for removably retaining said culinary instruments in said slots, said retaining means being removable from said base portion positioning means; and (d) a cover portion separate from said retaining means including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case.

2. A case for culinary instruments comprising:

(a) a base portion having opposite ends;

(b) base portion positioning means defining a plurality of slots for receiving and releasably positioning a plurality of prespecified types of culinary instruments in said base portion, said base portion positioning means being integrally molded with a portion of said base portion;

(c) retaining means for removably retaining said culinary instruments in said slots, said retaining means being removable from said base portion positioning means; and (d) a cover portion including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case.

3. A case for culinary instruments comprising:

(a) a base portion having opposite ends, said base portion comprising first and second hingeably connected base portion sections, said second base portion section being hingeable with respect to said first base portion section to a work station position wherein said second base portion section is operative as an easel support for maintaining said first base portion section in an angular disposition on a supporting surface;

(b) base portion positioning means in said first base portion section operative for receiving and releasably positioning a plurality of instruments in said base portion; and (c) a cover portion including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case.

4. In the case of claim 3, said first and second cover portion sections being hingeably connected to said first and second base portion sections, respectively, and being dimensioned and configured for substantially covering said first and second base portion sections, respectively.

5. In the case of claim 4, said second cover portion section being hingeable to a fully open position wherein said second cover portion engages said second base portion section and said supporting surface to prevent said second base portion section from pivoting outwardly relative to said first base portion section in order to maintain said first base portion section in a predetermined angular disposition on said supporting surface.

6. The case of claim 5 further comprising cover portion positioning means in said first cover portion section operative for releasably positioning a plurality of culinary instruments in said first cover portion section.

7. In the case of claim 4, said second cover portion section also being engageable with said first base portion section to prevent said second base portion section from being pivoted inwardly relative to said first base portion section in order to further retain said first base portion section in said predetermined angular disposition on said supporting surface.

8. A case for culinary instruments comprising:

(a) a base portion having opposite ends, said base portion including a bottom wall comprising first and second bottom wall sections, and an upstanding peripheral sidewall on said bottom wall, said sidewall extending around substantially the entire periphery of said base portion bottom wall, attached to said sidewall, said sidewall including first and second sidewall sections on said first and second bottom wall sections, respectively, said first bottom wall section and said first sidewall section defining a first base portion section, said second bottom wall section and said second sidewall section defining a second base portion section, said first and second base portion sections being hingeably connected;

(b) base portion positioning means operative for receiving and releasably positioning a plurality of instruments in said base portion; and (c) a cover portion including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case, said cover portion being hingeably attached to said sidewall.

9. A case for culinary instruments comprising:

(a) a base portion having opposite ends;

(b) base portion positioning means operative for receiving and releasably positioning a plurality of knives in said base portion, said base portion positioning means including means defining a plurality of elongated slots for receiving the blades of said knives and means releasably frictionally engageable with the blades of said knives to retain said knives in said slots;

(c) a removable retaining plate extending across at least a portion of said slots for retaining said knives in said slots; and (d) a cover portion including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case.

10. A case for culinary instruments comprising:

(a) a base portion having opposite ends;

(b) base portion positioning means operative for receiving and releasably positioning a plurality of knives in said base portion, said base portion positioning means defining a plurality of elongated slots for receiving the blades of said knives and including a plurality of longitudinally spaced bumps projecting inwardly in each of said slots from opposite sides thereof for frictionally engaging the blades of said knives to retain said knives in said slots; and (c) a cover portion including first and second cover portion sections which are hingeably attached to said base portion at opposite ends thereof and hingeable between closed positions wherein said cover portion sections cooperate with said base portion to define a substantially closed compartment for containing said instruments and open positions wherein said base portion is substantially open and said instruments are removable from said case.

* * * * *